United States Patent [19]

Schiel

[11] Patent Number: 5,012,730

[45] Date of Patent: May 7, 1991

[54] PRESS ROLL FOR PAPER MACHINES

[75] Inventor: Christian Schiel, Heidenheim, Fed. Rep. of Germany

[73] Assignee: J.M. Voith GmbH, Heidenheim, Fed. Rep. of Germany

[21] Appl. No.: 467,003

[22] Filed: Jan. 18, 1990

[30] Foreign Application Priority Data

Jan. 19, 1989 [DE] Fed. Rep. of Germany ..... 3901468

[51] Int. Cl.[5] ..... B30B 3/04; B21B 13/02

[52] U.S. Cl. ..... 100/160; 100/168; 100/169; 29/116.2; 29/123

[58] Field of Search ..... 100/160, 162 B, 168, 100/169, 155 R; 29/116.2, 123, 129; 101/375, 348

[56] References Cited

U.S. PATENT DOCUMENTS

| | | | |
|---|---|---|---|
| 1,759,192 | 5/1930 | Fulk | 29/123 |
| 1,763,124 | 6/1930 | Barber | 101/375 |
| 2,787,956 | 4/1957 | Kirby et al. | 29/129 |
| 2,970,339 | 2/1961 | Hausman | 100/162 B |
| 3,019,511 | 2/1962 | Hornbostel | 100/162 B |
| 3,161,125 | 12/1964 | Hornbostel | 29/123 |
| 4,253,392 | 3/1981 | Brandon et al. | 100/155 R |
| 4,768,050 | 8/1988 | Beery | 100/162 B |

OTHER PUBLICATIONS

Excerpt from Wochenblatt fuer Papierfabrikation, 11/12 1988, "Roll Covers for Wide Nip Presses".

*Primary Examiner*—Paul T. Sewell
*Assistant Examiner*—M. D. Patterson
*Attorney, Agent, or Firm*—Jeffers, Hoffman & Niewyk

[57] ABSTRACT

Press roll with a tubular cylinder, featuring on each of its two ends a roll head with a journal, specifically for use in a roll press consisting of the press roll and a backing roll with controlled deflection, for the treatment of web type material such as a paper web or the like. The inside surface of the tubular cylinder is so shaped across the web width that the shape of the flex line of the tubular cylinder will approximate during operation the flex line of the roll shell of the backing roll. This yields a press roll having a relatively thin-walled tubular cylinder which is lightweight. Nonetheless, an extensively constant line force is achieved in the press gap of the roll press across the web width.

10 Claims, 2 Drawing Sheets

Fig.1
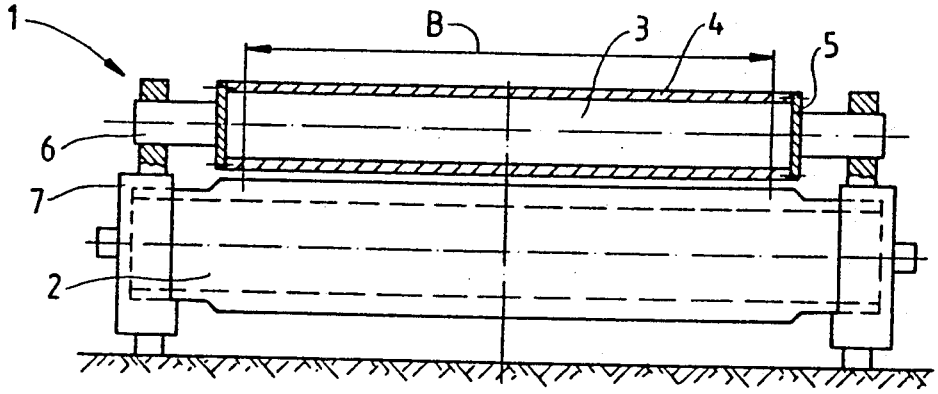
Fig.2
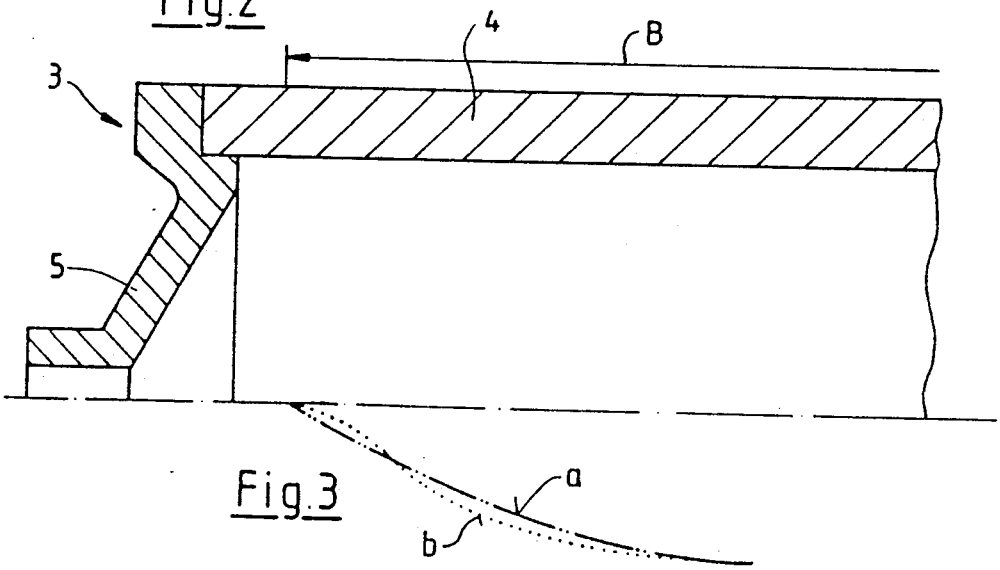
Fig.3
Fig.4
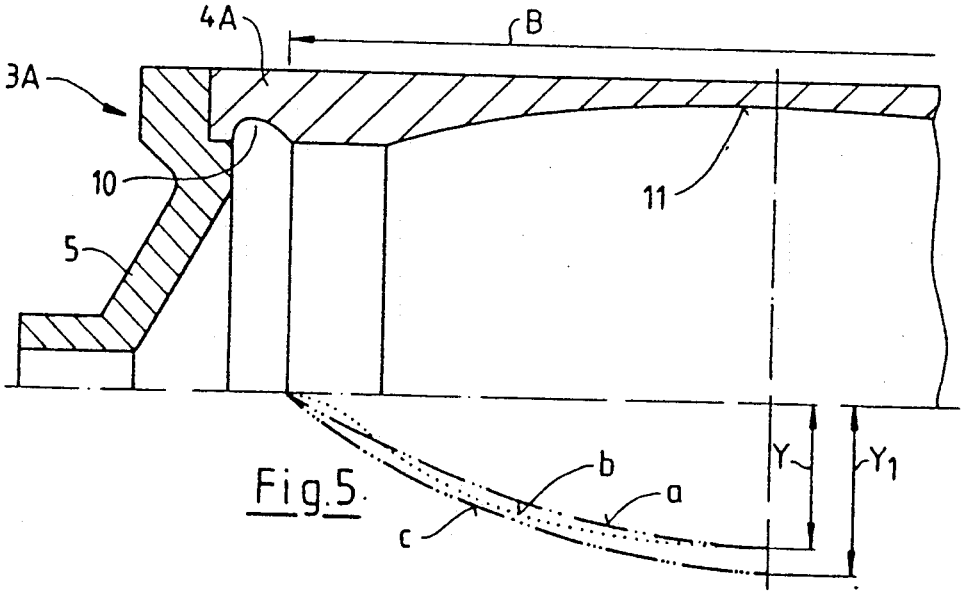
Fig.5

PRESS ROLL FOR PAPER MACHINES

BACKGROUND OF THE INVENTION

The present invention concerns a press roll for use in a roll press of a paper machine for the treatment of web type material. More particularly, such a press roll is arranged together with a backing roll to form a press gap therebetween, with the deflection of the backing roll being controllable. The press roll comprises a tubular cylinder having a wall thickness amounting to up to one-eighth of the roll diameter. Each roll end includes a cylinder head with a journal.

Press rolls of the above type are known and, by and large, also have proved themselves to be acceptable in performance. Their specific purpose, in interaction with a backing roll of controllable deflection, is to treat material, which generally is continuous and web-shaped, in a specific way. In connection with paper machines, press rolls of the said and known type are used, e.g., in so-called press stations, for instance in a wet press or in calendering stands As the width of the paper machines and also their operating speed increases, the problem of maintaining a constant line force across the entire web width assumes decisive significance.

In the operation of a roll press for the treatment of continuous web type material, it has been shown (compare Wochenblatt fuer Papierfabrikation, 11/12, 1988, page 490) that the tubular cylinder of a press roll deflects under the influence of the line force in various ways, depending on its wall thickness.

In one way, the flexure occurs as a beam deflection resulting from the support of the tubular cylinder by way of the journals of the cylinder heads in a pillow block. In another way, a flattening (or ovalization) of the round cross section of the tube occurs on the tubular cylinder, due to the radially effected load in the press plane between press roll and backing roll.

The said flattening of the tubular cylinder, also called shell deflection, is uneven and non-uniform across the width of the roll press. On its ends, the tubular cylinder is reinforced by the roll head in such a way that no flattening will occur there. However, with increasing distance from the heads, i.e., from the support bearing, the support effect of the head decreases with thin-walled tubular cylinders. The said support effect approaches "zero" in the center area of the roll press. The flattening, i.e., the radial deformation of the tubular cylinder is noteworthy especially when the wall thickness is small as compared to the roll diameter, for instance one-eighth thereof or less.

While the flex line of a beam, due to the line load of the backing roll, shows a pattern that is simple to compute, the shell deformation of the tubular cylinder across the width of the roll press can be calculated only with difficulty. This shell deflection of the tubular cylinder can be determined only at considerable computation expense making use of the so-called "finite elements" calculation. It has been demonstrated that the patterns of shell deflection and beam deflection vary, viewed across the width of the roll press.

If a roll press is comprised of a backing roll with controllable deflection and a plain press roll with a relatively thin-walled tubular cylinder, the beam deflection of the press roll can be extensively compensated for by way of controlling the deflection of the backing roll. So far it has not been possible to correct also the radial deformation, i.e., the deflection caused by shell deflection, or to compensate for it. Thus, impermissible non-uniformities remain in the line force distribution, which results in impermissible quality fluctuations in the web type material.

Basically, it would be conceivable to use instead of the plain press roll a second roll with controllable deflection. In view of the additional expense, however, this proposed solution is unrealistic.

For minimization of the error resulting from the shell deflection it is known to dimension the wall thickness of the tubular cylinder so large that the shell deflection relative to the overall deflection of the press roll will be negligible. However, this leads to an expensive and heavy roll.

The problem underlying the invention is to provide a press roll of the first mentioned type that has a relatively thin-walled tubular cylinder and which is therefore lightweight, but which in being pressed onto a backing roll with controllable deflection nonetheless has a flex line which maximally approximates that of the backing roll. It is meant by a "relatively thin-walled tubular cylinder" one where the wall thickness amounts to $\frac{1}{8}^{th}$ to $1/25^{th}$ of the outside diameter.

SUMMARY OF THE INVENTION

This problem is solved through the features of the present invention. In accordance with the invention, the tubular cylinder, viewed across the machine width, is designed with an uneven wall thickness. For instance, the tubular cylinder is made thinner on those spots where the flex line of the tubular cylinder would otherwise be flatter than that of the backing roll. Or, the tubular cylinder is made thicker on those spots where previously there occurred too much deflection as compared to the flex line of the backing roll.

BRIEF DESCRIPTION OF THE DRAWINGS

The invention and the prior art will be more fully explained with the aid of the drawings.

FIG. 1 shows a partial section view of a prior art roll press consisting of a press roll and a backing roll;

FIG. 2 shows an enlarged partial longitudinal section of the press roll of FIG. 1;

FIG. 3 shows the flex lines of the press roll according to FIG. 2 and of the pertaining backing roll;

FIG. 4 shows a press roll in accordance with the present invention with a peripheral groove in the area of the end and a recess in the center area;

FIG. 5 shows the flex line of the press roll according to FIG. 4 as compared to the flex lines of FIG. 3;

DESCRIPTION OF THE PREFERRED EMBODIMENT

Figure 6:
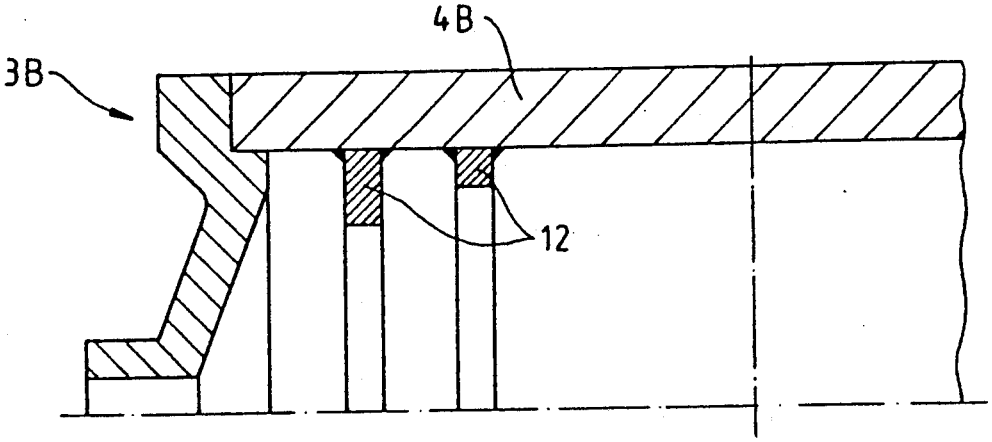
FIG. 6 shows a press roll with reinforcement rings, in accordance with another embodiment of the present invention.

FIG. 1 shows a conventional roll press 1 comprised of a backing roll 2 with controllable deflection and a press roll 3 (shown in section). The two rolls are opposed in a press plane through which the web type material, for instance a paper web, is being passed between the rolls and specifically treated in the process. The web width is marked B; it is approximately equal to the width of the press zone. The press roll 3 comprises a tubular cylinder 4 which is normally somewhat longer than the we width B. Provided on each end of the tubular cylinder 4 is a head 5 with a journal 6 which is mounted in a pillow block 7. Thrust devices (not illustrated) force the backing roll 2 on the press roll 3 from below, whereby the latter deflects upward.

In the process, the backing roll 2 is specifically stressed across its length, i.e., across the width of the roll press 1 and originating from the inside of the roll, in such a way that it will maximally follow the deflection of the press roll 3. The latter, in turn, is subjected to a beam deflection and to a shell deflection because the wall thickness of the tubular cylinder 4 is relatively small in relation to its outside diameter.

FIG. 2 shows a partial section of the press roll 3 with a roll head 5 relative to FIG. 1 flanged thereto. The wall thickness of the tubular cylinder 4 is approximately 1/10 of the outside diameter and, in conventional fashion, is uniform across the length of the roll.

FIG. 3 shows the flex lines involved with the roll press according to FIG. 1, where in contrast from FIG. 1 it is presumed that the backing roll now exerts from above a press force in the form of a line force on the tubular cylinder 4. To begin with, there is a flex line a indicated by a dot-dot-dash line, which is the beam deflection line of the backing roll 2, and there is additionally a flex line b indicated by a dotted line that results from the superimposition of the beam deflection and shell deflection of the press roll 3 at constant line load. The flex lines are illustrated only for the center area of the tubular cylinder 4, i.e., for the area of the web width B. The parts of the flex lines that are located outside the web width B may be disregarded in the present considerations, because the matching shape of the rolls is of interest only within the press zone.

The objective of the present invention is to modify the press roll 3 in such a way that its flex line (viewed across the width of the press zone B of the roll press 1) will not exhibit any impermissibly large variations from the flex line of the backing roll 2.

This objective is accomplished either by making the tubular cylinder thinner at those spots where the flex line b is flatter than the flex line a, or by making the wall thickness greater in areas where the flex line b has a steeper progression than the flex line a.

FIG. 4 shows a first embodiment of a modified press roll 3A whose tubular cylinder 4A has an uneven wall thickness across the width of the roll press 1. The tubular cylinder 4A has a peripheral groove 10 in its end area; additionally, the center area of the tubular cylinder 4A has a recess 11 machined therein so as to have a barrel shape. This recess 11 may approach the strength limit of the tubular cylinder 4A. The peripheral groove 10 is preferably located outside the press zone B. It effects a reduction of the stiffening of the ends of the tubular cylinder 4A caused by the roll covers 5.

Illustrated in FIG. 5 are the flex lines a and b according to FIG. 3 and the flex line c of the modified press roll 3A according to FIG. 4 (dash/three-dotted). The latter flex line results from providing the peripheral groove 10 in the marginal area and the recess 11 in the center area. This flex line c results again from the superimposition of a beam deflection line and a shell deflection line. Its shape corresponds extensively, however, with the beam deflection line a of the backing roll. In other words, when adapting the two maximum deflections Y and $Y_1$ in the center of the roll press to one another, the deflection lines a and c will be extensively in agreement. This favorable shape of the flex line c i brought about by the peripheral groove 10 and the recess 11 being arranged at points where the flex line b is shallower than the flex line a.

The recess 11 in the center area of the press roll 3A may also be realized through a plurality of circular grooves that differ in width and depth.

More generally, the following should be noted: if a conventional tubular cylinder appears to be too thin-walled in view of the disparity of deflection lines a and b, it is not now necessary to opt for a tubular cylinder with a greater wall thickness as a solution. According to the present invention, it is quite possible to further weaken the thin-walled tubular cylinder down to its limit strength. While this will increase the maximum deflection of the press roll 3A, the shape of the flex line will adapt considerably better than before to the deflection line of the backing roll 2.

FIG. 6 shows another embodiment of the press roll 3B of the present invention. Stiffening rings 12 of varying diameter and/or varying width accomplish the influencing of the flex line. This measure is applied especially to give preferential support to those areas on a thin-walled tubular cylinder 4B which deflect heavily with regard to the beam deflection line. Therefore, the stiffening rings 12 in FIG. 6 are arranged at points where according to FIG. 3 the flex line b is steeper than the flex line a.

Figure 7:
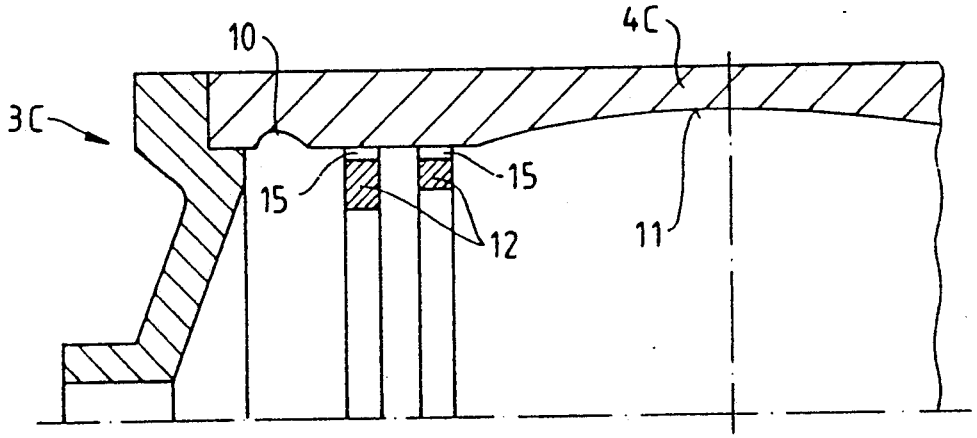
FIG. 7 shows a press roll with reinforcement rings a well as with a peripheral groove and a recess, in accordance with yet another embodiment of the present invention.

FIG. 7 shows an embodiment of the press roll 3C of the present invention featuring on its end a peripheral groove 10, a center recess 11 and interposed stiffening rings 12. This makes it possible to adapt the bending line resulting from the beam deflection and shell deflection of the tubular cylinder 4C (compare curve c in FIG. 5) very accurately to the actual conditions in a roll press 1. If the press roll 3C according to FIG. 7 is water-cooled, axially parallel, open conduits 15 may be provided in the stiffening rings 12, distributed across the circumference, through which cooling water can flow.

Figure 8:
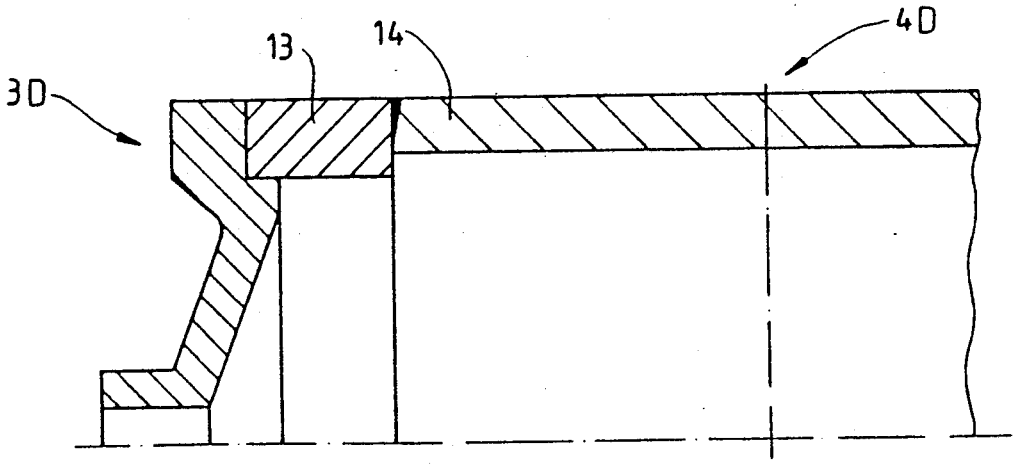
FIG. 8 shows a press roll whose shell is composed of three tubular sections, in accordance with a further embodiment of the present invention.

FIG. 8 shows a fourth embodiment of the press roll 3D of the present invention. Its tubular cylinder 4D consists of three butt-welded tubular sections, of which in the drawing only the tubular sections 13 and 14 are visible. The wall thickness of the outer tubular sections 13 is greater than the wall thickness of the center tubular section 14. This press roll 3D offers the advantage that without any inside processing of the tubular cylinder 4D a noticeable effect on the flex line will be achieved. Naturally, this flex line can be further optimized by the measures described above. Of course, the tubular cylinder 15 may also be composed of more than three tubular sections.

What is claimed is:

1. A press roll for the treatment of web type material having a web width for use in combination with a backing roll having controllable deflection, wherein the press roll together with the backing roll form a press gap therebetween through which the web type material passes, said press roll and said backing roll each having characteristic flex lines indicative of a flexure profile during operation, said press roll comprising:

a tubular cylinder having a length and a diameter and a wall thickness, the wall thickness being at most about one-eighth of the roll diameter;

a pair of cylinder heads each disposed at a respective end of said tubular cylinder and each including a journal;

said tubular cylinder including at least one internal peripheral groove such that the wall thickness of the tubular cylinder is non-uniform across the cylinder length, and such that in operation the flex line of the press roll is adapted to the flex line of the backing roll at least within the web width.

2. The press roll of claim 1, in which the internal peripheral groove of the tubular cylinder is disposed in an area bordering on the cylinder head.

3. A press roll for the treatment of web type material having a web width for use in combination with a backing roll having controllable deflection, wherein the press roll together with the backing roll form a press gap therebetween through which the web type material passes, said press roll and said backing roll each having characteristic flex lines indicative of a flexure profile during operation, said press roll comprising:

a tubular cylinder having a length and a diameter and a wall thickness, the wall thickness being at most about one-eighth of the roll diameter;

a pair of cylinder heads cover each disposed at a respective end of said tubular cylinder and each including a journal;

disposed at a respective end including a journal;

said tubular cylinder including a center area having a recess such that the wall thickness of the tubular cylinder is non-uniform across the cylinder length, and such that in operation the flex line of the press roll is adapted to the flex line of the backing roll at least within the web width.

4. The press roll according to claim 3, in which the tubular cylinder is composed of several tube sections, with the inside diameter of the tubular cylinder increasing toward the center, from tube section to tube section.

5. A press roll for the treatment of web type material having a web width for use in combination with a backing roll having controllable deflection, wherein the press roll together with the backing roll form a press gap therebetween through which the web type material passes, said press roll and said backing roll each having characteristic flex lines indicative of a flexure profile during operation, said press roll comprising:

a tubular cylinder having a length and a diameter and a wall thickness, the wall thickness being at most about one-eighth of the roll diameter;

a pair of cylinder covers each disposed at a respective end of said tubular cylinder and each including a journal;

said tubular cylinder including a marginal area in which stiffening rings are provided on the inside of the tubular cylinder such that the wall thickness of the tubular cylinder is non-uniform across the cylinder length, and such that in operation the flex line of the press roll is adapted to the flex line of the backing roll at least within the web width.

6. The press roll according to claim 5, in which stiffening rings of varying diameter are provided across the cylinder length.

7. The press roll according to claim 5, in which stiffening rings of varying thickness are provided across the cylinder length.

8. The press roll according to claim 5, in which the stiffening rings include radially outer areas having axially parallel conduits therein.

9. The press roll according to claim 6, in which the stiffening rings include radially outer areas having axially parallel conduits therein.

10. The press roll according to claim 7, in which the stiffening rings include radially outer areas having axially parallel conduits therein.

* * * * *

UNITED STATES PATENT AND TRADEMARK OFFICE

CERTIFICATE OF CORRECTION

PATENT NO. : 5,012,730

DATED : May 7, 1991

INVENTOR(S) : Christian Schiel

It is certified that error appears in the above-identified patent and that said Letters Patent is hereby corrected as shown below:

Column 1, line 55, before "shell" insert --radial--.

Column 3, line 7, delete "we" and substitute therefor --web--.

Column 4, line 6, delete "i" and substitute therefor --is--.

Column 5, Claim 3, line 27, delete "cover".

Column 5, Claim 3, lines 30-31, delete "disposed at a respective end including a journal;".

Signed and Sealed this

First Day of December, 1992

*Attest:*

*Attesting Officer*

DOUGLAS B. COMER

*Acting Commissioner of Patents and Trademarks*